US007452099B2

(12) United States Patent
Evans et al.

(10) Patent No.: US 7,452,099 B2
(45) Date of Patent: Nov. 18, 2008

(54) PORTABLE LIGHT DEVICE

(75) Inventors: Donald F. Evans, Pinehurst, NC (US); Mark D. Schmidt, Durham, NC (US); Larson Isely, Releigh, NC (US); Jeffrey Hatley, Mebane, NC (US); Michael Roth, Austin, TX (US)

(73) Assignee: Cyberlux Corporation, Durham, NC (US)

( * ) Notice: Subject to any disclaimer, the term of this patent is extended or adjusted under 35 U.S.C. 154(b) by 32 days.

(21) Appl. No.: 11/336,562

(22) Filed: Jan. 21, 2006

(65) Prior Publication Data

US 2006/0187658 A1 Aug. 24, 2006

Related U.S. Application Data

(60) Provisional application No. 60/645,788, filed on Jan. 21, 2005.

(51) Int. Cl.
*F21L 4/02* (2006.01)
*F21V 33/00* (2006.01)

(52) U.S. Cl. ..... 362/184; 362/232; 362/235; 362/250; 362/800

(58) Field of Classification Search ..... 362/157, 362/184, 187, 227, 232, 235, 238–240, 244, 362/250, 800
See application file for complete search history.

(56) References Cited

U.S. PATENT DOCUMENTS

| | | | | |
|---|---|---|---|---|
| 3,233,092 | A | 2/1966 | Umholtz | |
| 3,963,972 | A | 6/1976 | Todd | |
| 4,244,011 | A | 1/1981 | Hammel et al. | |
| 4,575,784 | A | 3/1986 | Diau | |
| 5,344,339 | A | 9/1994 | Cheslock | |
| 5,955,866 | A | 9/1999 | Peng | |
| 5,982,138 | A | 11/1999 | Krieger | |
| 5,993,022 | A * | 11/1999 | Neyer et al. | 362/199 |
| 6,215,273 | B1 | 4/2001 | Shy | |
| D444,125 | S | 6/2001 | Shy | |
| 6,616,300 | B1 | 9/2003 | Hrabal | |
| D481,813 | S | 11/2003 | Krieger et al. | |
| 6,756,764 | B2 | 6/2004 | Smith et al. | |
| 2004/0130891 | A1 * | 7/2004 | Twardawski | 362/157 |
| 2004/0141316 | A1 * | 7/2004 | Twardawski | 362/184 |

* cited by examiner

*Primary Examiner*—Sandra O'Shea
*Assistant Examiner*—Jason Moon Han
(74) *Attorney, Agent, or Firm*—Alston & Bird LLP

(57) ABSTRACT

The present invention provides a light device comprised of a body, a handle, a user interface, and a positionable arm that is structured to pivotally support a lighting element assembly. The light device may be configured to be portable and carried or otherwise manipulated by a user grasping the handle. In one embodiment, the body of the light device defines first and second support surfaces that are structured to stably support the weight of the light device in first and second illumination positions, respectively.

21 Claims, 19 Drawing Sheets

PORTABLE LIGHT DEVICE

CROSS-REFERENCE TO RELATED APPLICATIONS

The present application claims priority to U.S. Provisional Application. No. 60/645,788 filed Jan. 21, 2005; the contents of which are incorporated herein in their entirety.

FIELD OF THE INVENTION

The present invention relates generally to the field of illumination and, more particularly, the invention relates to a solid state lighting source such as a portable light-emitting diode ("LED") device that provides for directed, multi-level, illumination that may be controlled by a user to manage battery life.

BACKGROUND OF THE INVENTION

Frequently, homes, offices and industrial plant facilities experience many types of emergency situations involving power failures where an interior or exterior area is rendered without light. Such power failures may result from electrical short circuits, brownouts, fire, accidents, natural disasters (e.g., floods, hurricanes, tornados, etc.) or a planned shutdown of electricity within a facility or dwelling. Automotive commuters also frequently find themselves without power following accidents, vehicle break downs, and the like.

In each of the circumstances above, it would be desirable for person to possess a portable light device that is adapted to provide a source of local illumination and electrical power. However, the preferred type or mode of illumination may change depending upon the specific power outage circumstance. For example, it is generally preferable to have a broadly ranging flood-light type of illumination to reveal a person's path as they attempt to transit a darkened room or corridor. Alternatively, it is generally preferable to have a compact spot-light type of illumination to reveal a person's work area as they attempt to fix a flat-tire along a darkened road side.

In view of the above, a need exists to provide a portable light device that is capable of activation in response to a disruption of power. It would be desirable for the device to be compact and lightweight such that it can be moved simply and quickly from location to location. It is further desirable for the device to be efficiently powered by a battery pack such that it is capable of constant illumination lasting for several days or even weeks. It is further desirable that the portable light device be readily adapted to provide a spot-light mode of illumination, a flood-light mode of illumination, or a combination thereof. Finally, the device should provide real-time battery life information to a user such that the performance of the device may be tailored to extend or shorten expected battery life as needed.

BRIEF SUMMARY OF THE INVENTION

The present invention addresses the above needs and achieves other advantages by providing a light device comprised of a body, a handle, a user interface, and a positionable arm that is structured to pivotally support a lighting element assembly. In one embodiment, the light device is configured to be portable and carried or otherwise manipulated by a user grasping the handle. In one embodiment, the body of the light device defines first and second support surfaces that are structured to stably support the weight of the light device in first and second illumination positions, respectively.

In one embodiment, the lighting element assembly of the light device may include an array of light emitting diodes ("LEDs") comprising a first LED disposed in reflective proximity to a narrowing lens or reflector that is adapted to provide a spot-light mode of illumination and a second LED that is adapted for a flood-light mode of illumination, wherein the first and second LEDs are disposed in electrical communication with a battery for supplying electrical energy to the array of LEDs, a control circuit, and a user interface system. In such embodiments, the control circuit may be configured to allow a user to engage the array of LEDs to illuminate in the spot-light mode of illumination, the flood-light mode of illumination, or a combination thereof, based upon input signals provided by the user interface system. In other embodiments, more or fewer first and second LEDs may be used.

In another embodiment, the light device may be comprised of an array of LEDs, a pivot member adapted to support the array of LEDs, and a positionable arm having an electro-mechanical hinge that is adapted to allow the pivot member to pivot a pivot range of at least 360 degrees relative to the positionable arm. The light device may also include a housing structured to at least partially enclose an electrical power system for providing electrical power to the array of LEDs, wherein the positionable arm is coupled to the housing and the electro-mechanical hinge is structured to provide uninterrupted electrical power from the power source to the array of LEDs while also allowing the pivot member to pivot over its full pivot range. In one embodiment, the electrical power system may include a battery. In another embodiment, the electrical power system may include one or more power cords that are adapted for coupling to an external power source such as a wall outlet, vehicle battery, and the like. In another embodiment, the electrical power system may include one or more power cords that are adapted for coupling to an external power drain such as a cell phone, PDA, laptop, radio, television, vehicle battery, or other electrically powered device.

In another embodiment, the light device may be comprised of a first array of LEDs structured to provide a spot-light mode of illumination at an alterable first intensity level, a second array of LEDs structured to provide a flood-light mode of illumination at an alterable second intensity level, an electrical power system structured to provide electrical power to the first array of LEDs and the second array of LEDs. One or more sensors may also be provided in electrical communication with the electrical power system for sensing electrical power information. The light device may also include a user interface structured to allow a user to change an operating mode between the spot-light mode of illumination, the flood-light mode of illumination, and a dual mode of illumination. The user interface may further be structured to allow the user to change the first intensity level and the second intensity level. The light device may also include a display and control circuitry disposed in electrical communication with the first array of LEDs, the second array of LEDs, the electrical power system, the user interface, the one or more sensors, and the display, wherein the control circuitry is adapted to present and update a power supply message to the display based upon the sensed electrical power information, the operating mode, the first intensity level, and the second intensity level.

Still other embodiments of the invention are directed to methods of operating a light device. For example, one embodiment comprises the steps of: sensing electrical power information; sensing mode of illumination information provided by a user via a user interface; sensing LED intensity information provided by the user via the user interface; directing an array of LEDs to operate in either a spot-light mode of illumination, a flood-light mode of illumination, or a dual mode of illumination based upon the sensed mode of illumination information; directing the array of LEDs to operate at desired intensity levels based upon the sensed LED intensity information; and displaying a power supply message to the user based upon the sensed electrical power information, the sensed mode of illumination information, and the sensed LED intensity information.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete and will fully convey the scope of the invention to those skilled in the art. Like numbers refer to like elements throughout.

Figure 1:
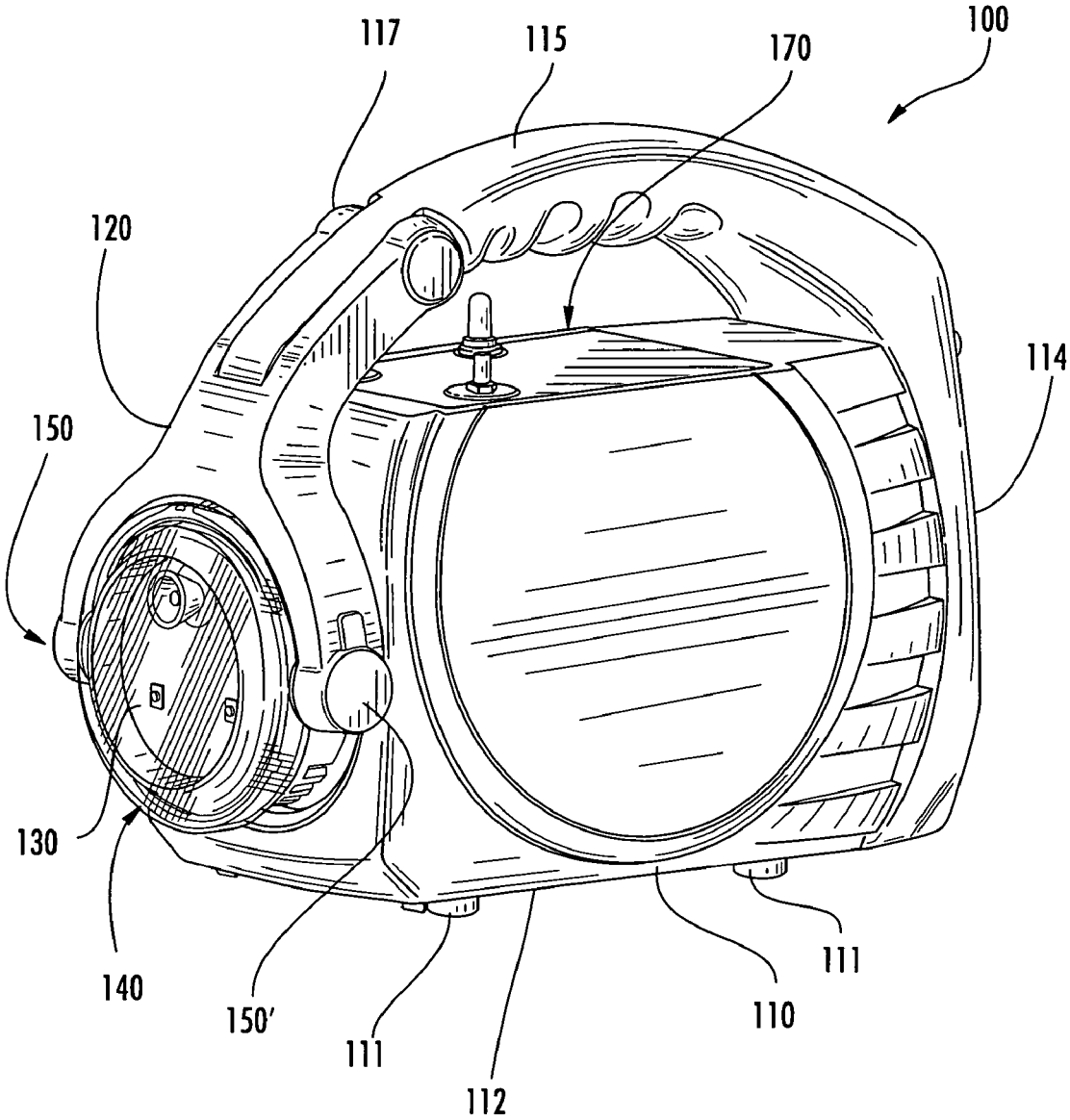
FIG. 1 illustrates a perspective view of a light device structured in accordance with one embodiment of the invention.
Figure 2:
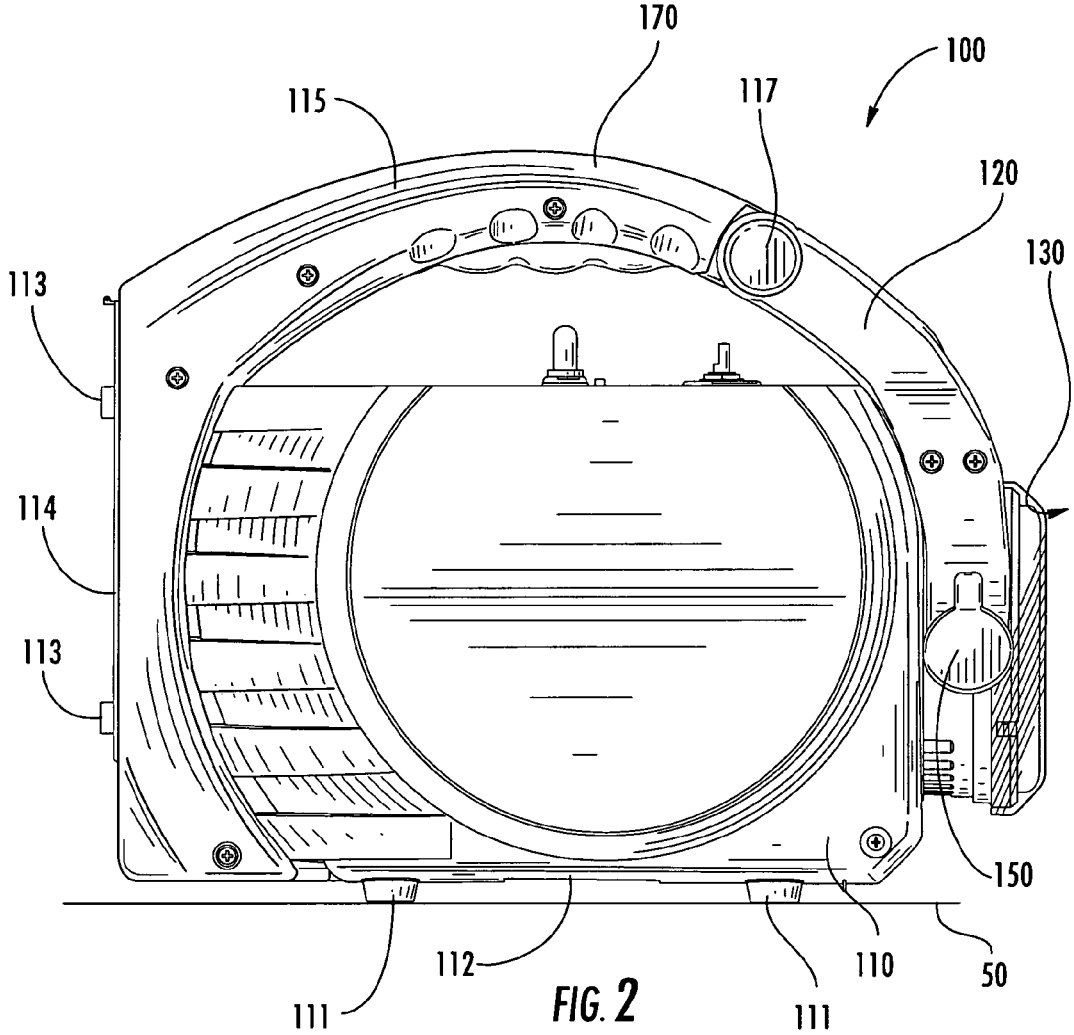
FIG. 2 illustrates a side view of a light device in a first illumination position disposed on its first support surface in accordance with one embodiment of the invention.
Figure 3:
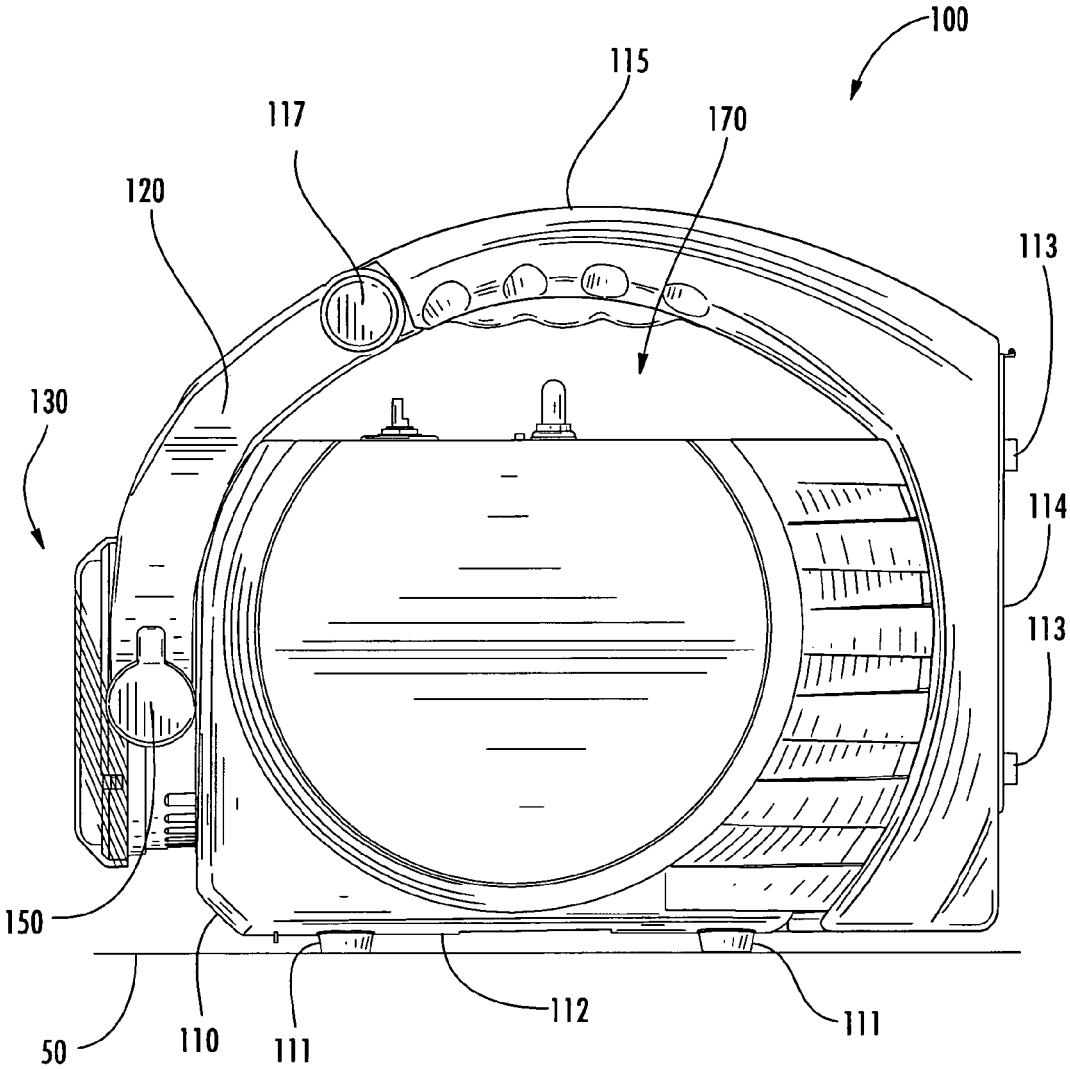
FIG. 3 illustrates an alternate side view of a light device structured in accordance with one embodiment of the invention.

Referring to FIGS. 1 though 8 collectively, there is illustrated a light device 100 structured in accordance with various embodiments of the invention. In one embodiment, the light device 100 is comprised of a body 110, a handle 115, a user interface 170, and a positionable arm 120 that is structured to support a lighting element assembly 130 as shown. In one embodiment, the light device is configured to be portable and carried or otherwise manipulated by a user grasping the handle 115. In such embodiments, the light device 100 is typically structured to be light-weight. For example, lighting devices 100 structured in accordance with various embodiments of the invention may weigh less than twenty pounds, preferably less than sixteen pounds, and more prefereably less than eleven pounds. The body 110 of the light device 100 may define a first support surface 112 and a second support surface 114, which are structured to stably support the weight of the light device 100 in first and second illumination positions, respectively.

Figure 4:
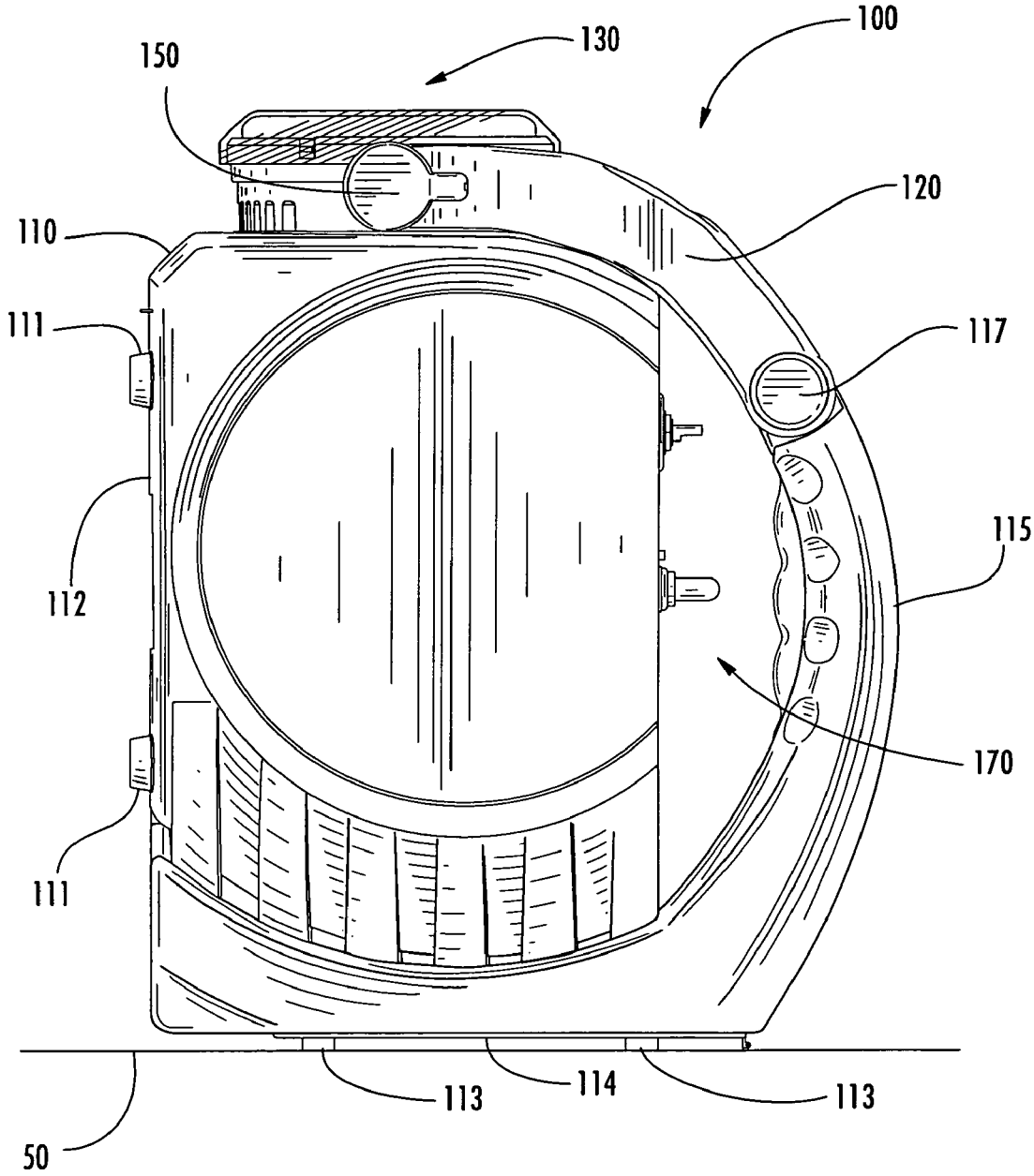
FIG. 4 illustrates a side view of a light device in a second illumination position disposed on its second support surface in accordance with another embodiment of the invention.

FIGS. 1-3 and 5-7 illustrate an exemplary light device disposed in a first illumination position and FIG. 4 illustrates an exemplary light device disposed in a second illumination position. In various embodiments, the first and/or second support surfaces 112, 114 may be adapted to receive one or more rugged feet 111, 113 for engaging a ground surface 50 (e.g., floor, table, road-side, etc.) as shown. In this regard, the first and/or second support surfaces 112, 114 may be protected from scuffing and other damage. Rugged feet 111, 113 comprised of rubber or polymer materials, such as the type depicted, are generally known in the art and, thus, are not described in detail here.

In various embodiments of the invention, the positionable arm 120 is extendable from a compact position to an extended position. FIGS. 1-8 depict an exemplary light device 100 having its positionable arm 120 disposed in a compact position in accordance with one embodiment of the invention. FIG. 9 depicts an exemplary light device having its positionable arm 120 disposed in a generally horizontal extended position in accordance with one embodiment of the invention. Although disposed in the depicted generally horizontal extended position, it is noted that positionable arms structured in accordance with various embodiments of the invention may be positioned by a user to hold multiple extended positions ranging between the compact position A (shown in dashed lines in FIG. 9) and the fully extended position B (shown in dashed lines in FIG. 9).

As noted above, the depicted positionable arm 120 is structured to support a lighting element assembly 130. In one embodiment, the lighting element assembly 130 is housed within a pivot member 140 that is rotatably coupled to the positionable arm 120 as shown. In the depicted embodiment, the pivot member 140 is rotatably coupled to the positionable arm by first and second electro-mechanical hinge assemblies 150, 151. The structure and operation of the first and second electro-mechanical hinge assemblies will be discussed in greater detail with regard to FIG. 10 below.

In various embodiments of the present invention, the lighting element assembly 130 comprises an array of light emitting diodes ("LEDs") as shown. In the depicted embodiment, the array of LEDs are disposed proximate an illumination side 142 of the pivot member 140 while a heat sink 145 is disposed proximate a non-illumination side 144 of the pivot member 140. In various embodiments, the heat sink 145 is disposed in heat transfer communication with the LEDs for cooling the LEDs as will be apparent to one of ordinary skill in the art. In other embodiments, a cooling fan or other device (not shown) may be used to further cool the LEDs. In still other embodiments, the pivot member may not include a non-illumination side such that two separate illumination sides may be provided on opposite surfaces of the pivot member (not shown). Should such embodiments be equipped with LEDs, then other thermal management structures could be used to cool the LEDs. For example, in one embodiment, a circular heat sink could be disposed generally about the perimeter edge of the pivot member (not shown). In still other embodiments, heat sinks, cooling fans, and the like may be altogether unnecessary as other more conventional light sources may be used (e.g., fluorescent, incandescent, resister based light sources, etc.).

Figure 6:
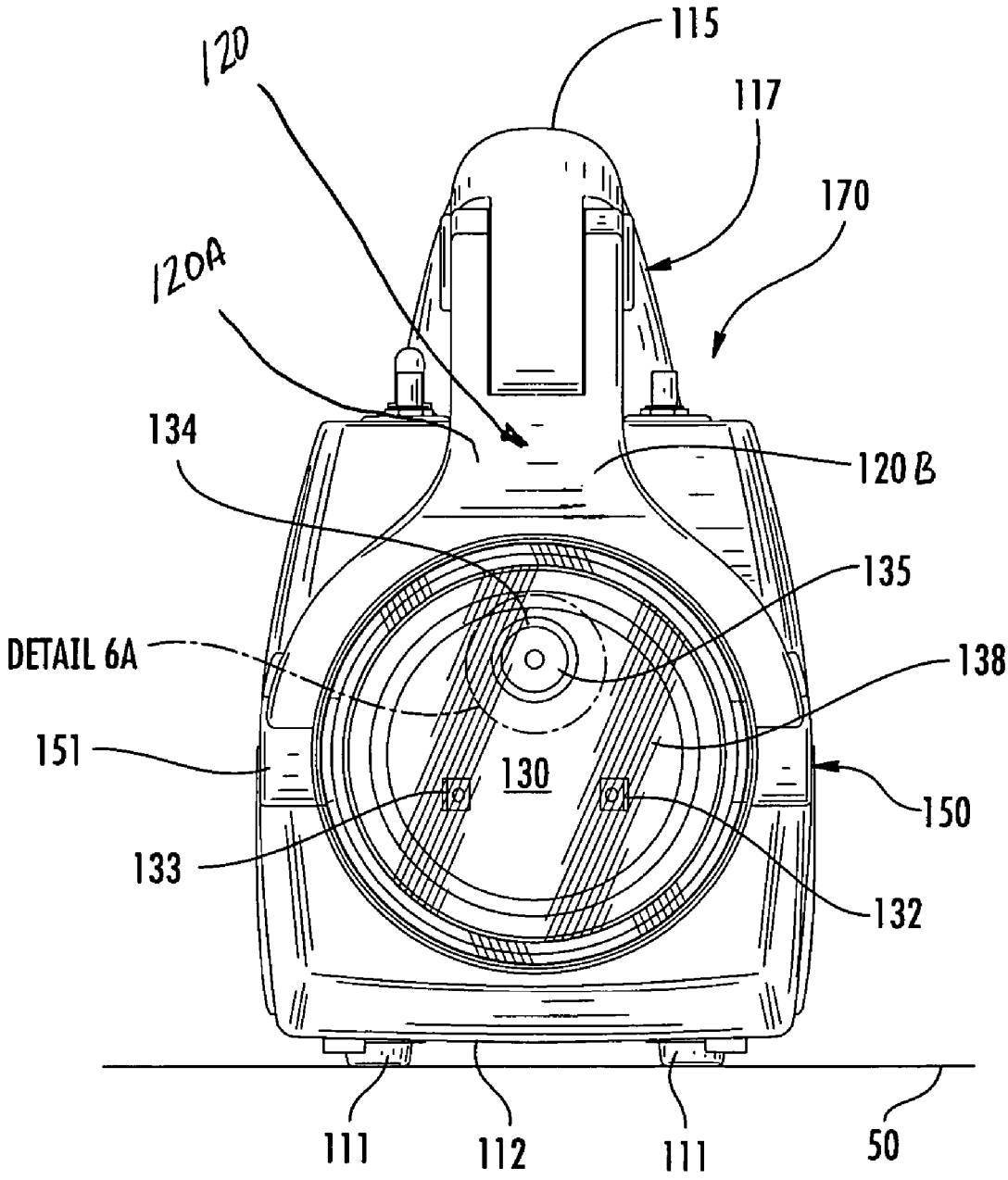
FIG. 6 illustrates a front view of a light device structured in accordance with one embodiment of the invention.
Figure 6A:
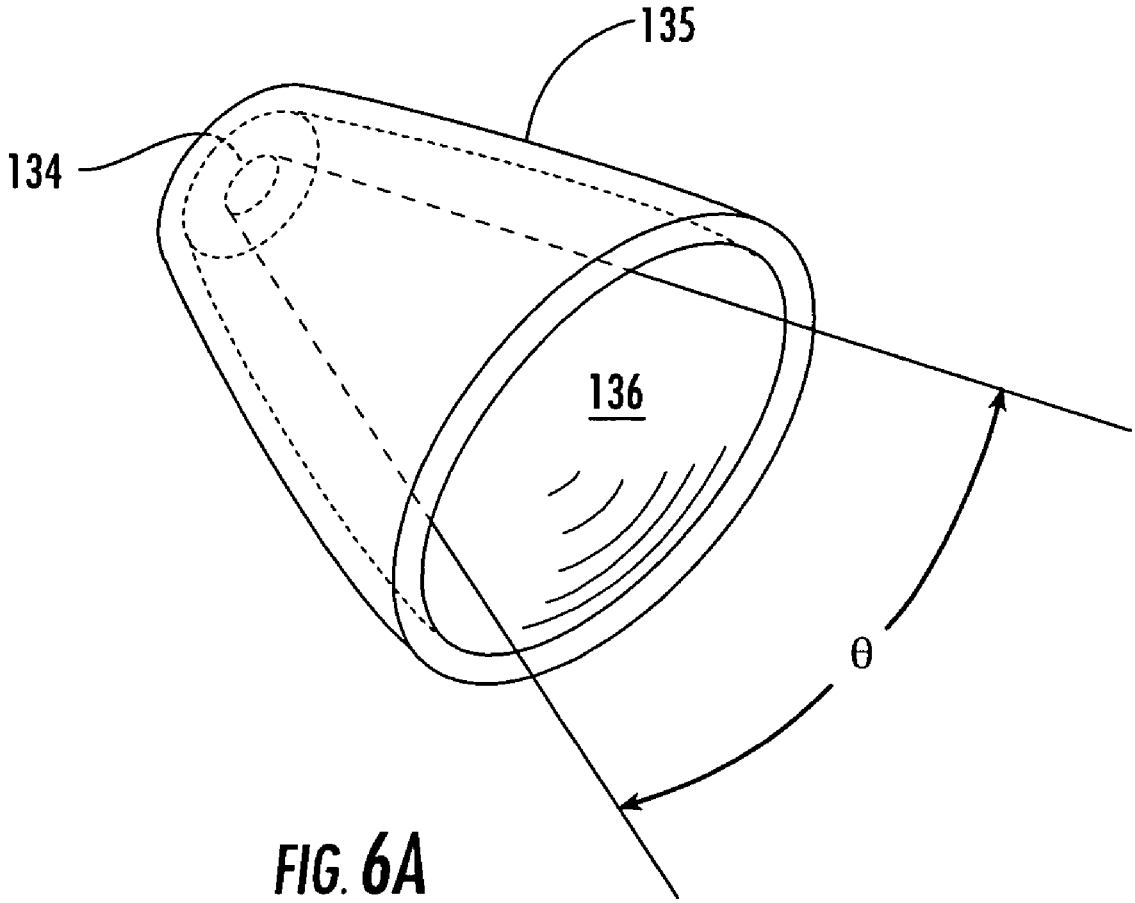
FIG. 6A is a detail illustration of a narrowing lens structured in accordance with one embodiment, taken along detail circle 6A of FIG. 6.
Figure 7:
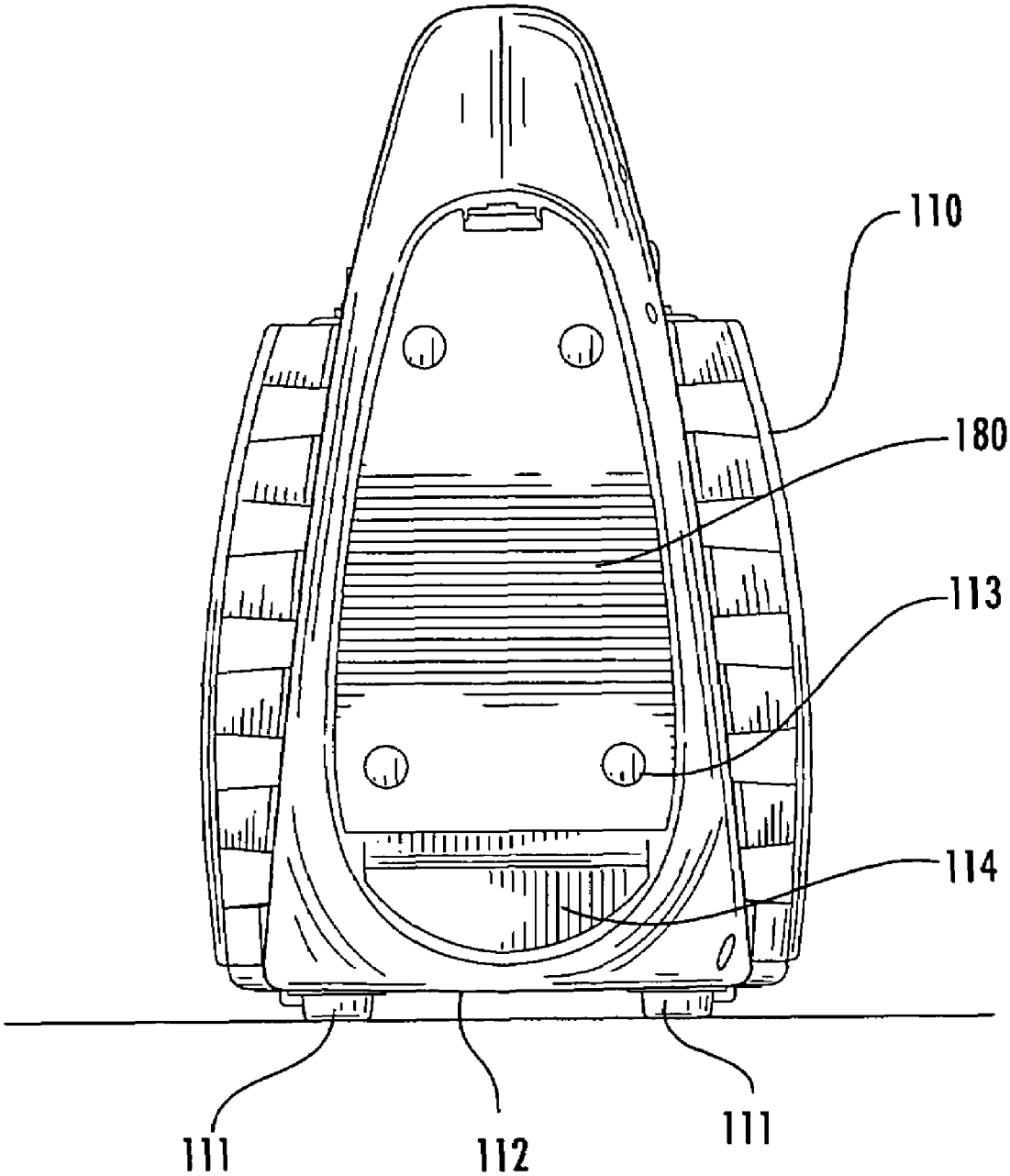
FIG. 7 illustrates a rear view of a light device structured in accordance with one embodiment of the invention.

Referring to FIG. 6, the depicted lighting element assembly 130 includes an array of three LEDs. A first LED 134 is disposed in reflective proximity to a generally conical LED optic 135 that is adapted to act as a narrowing lens and focus light emitted from the first LED 134 into a spot-light mode of illumination. For purposes of the present invention and appended claims the term "narrowing lens" includes any lens (e.g., fish-eye, elliptical, conical, etc.), reflector, optic, concentrator, or other device that is capable of reflecting or focusing light. Second and third LEDs 132, 133 are provided that are not disposed in reflective proximity to an LED optic and, thus, are adapted to provide a flood-light mode of illumination. Referring to FIG. 6A, LED optics structured in accordance with various embodiments of the present invention, such as the exemplary depicted LED optic 135, are generally conically-shaped and possess a reflective lens surface 136 positioned in reflective proximity to a centrally located LED 134 as shown. In various embodiments, LED optics may be comprised of ceramic materials, glass materials, polymers, composites, or combinations thereof. In still other embodiments, LED optics may be structured to narrow light emitted from a centrally located LED 134 to an illumination cone angle θ of approximately 4 to 50 degrees, preferably between 15 to 50 degrees, more preferably between 4 and 30 degrees, and still more preferably between 4 and 15 degrees.

Referring to FIG. 6, the depicted lighting element assembly 130 further comprises a reflecting surface 138 positioned about each of the first, second, and third LEDs 132, 133, and 134 as shown. As used herein, the term "reflecting surface" may refer to a mirrored surface, a shiny metallic surface such as a chrome plated surface, a non-shiny metallic surface, a dull surface having a matte finish, a generally opaque polymer surface, or any other surface that is capable of reflecting or disbursing light.

In the depicted embodiment, the second and third LEDs 132, 133 are positioned within apertures defined within the reflecting surface 138. In other embodiments, the lighting element assembly may include an LED array comprising more or fewer LEDs that are adapted for either spot or flood-light type illumination. In the depicted embodiment, the array of LEDs include three high brightness white LEDs that provide over 250 lumens of light output. However, in other embodiments, other types of LEDs may be used including, but not limited to, blue LEDs, red LEDs, orange LEDs, amber LEDs, yellow LEDs, green LEDs, bi- or tri-color LEDs, multi-colored LEDs, infrared LEDs, and ultraviolet LEDs. Such LEDs advantageously provide a relatively high level of illumination with relatively minimal power requirements as compared to traditional incandescent or resistor-based light bulbs.

The body 110 encloses and protects electrical circuitry for driving the illumination provided by the lighting element assembly 130. In various embodiments, the body 110 may be comprised at least partially of a durable polymer, rubber, metal, or other similar rugged materials. For example, in one embodiment the body 110 and other parts of the light device may be comprised, at least partially, of a lightweight, durable, polycarbonate such as LEXAN®. In other embodiments, the body 110 and other parts of the light device may be comprised, at least partially, of acrylonitrile butadien styrene ("ABS").

As will be apparent to one of ordinary skill in the art, electrical power is necessary to drive illumination of the lighting element assembly. In various embodiments, such electrical power is provided by an electrical power system. In one embodiment, the electrical power system may include one or more batteries (not shown). In such embodiments, the one or more batteries may be housed within the body 110. For example, in one embodiment, the one or more batteries may comprise a rechargeable lithium ion battery. In another embodiment, the one or more batteries may comprise a rechargeable lead acid battery. In still other embodiments, additional electrical power may be provided to the electrical power system by one or more power cords extending from the body 110 that are configured to electrically engage a wall outlet (not shown), a vehicle (e.g., automobile) cigarette lighter, and/or a vehicle battery. In another embodiment, electrical power may be provided from the electrical power system of the light device via a cord adapted to electrically engage a cell phone, PDA, laptop, radio, television, vehicle battery, or other electrical device. The above cords may be permanently coupled to the electrical power system of the light device or may be selectively coupled to a given port, node, terminal, or series of poles.

Figure 8:
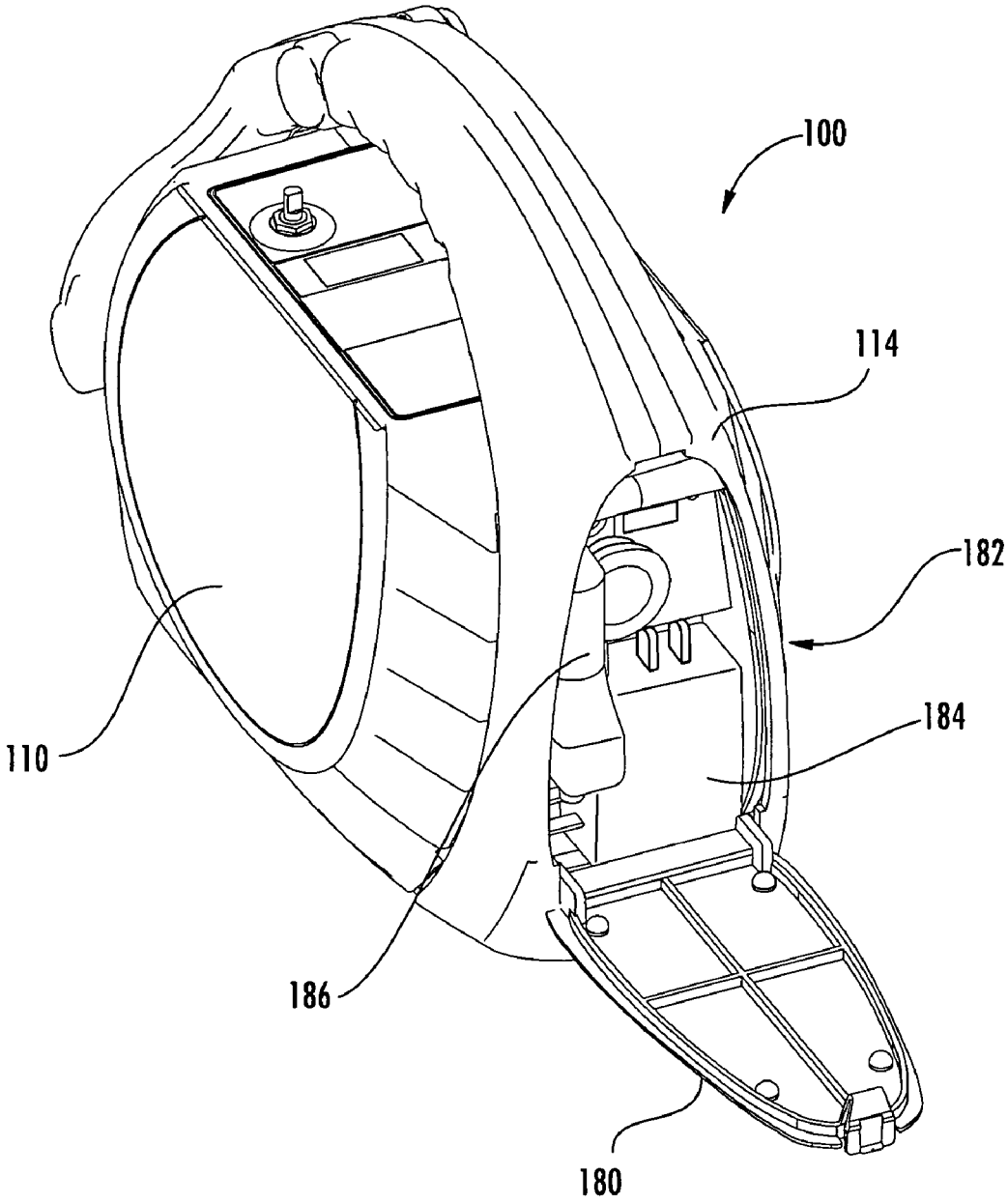
FIG. 8 is a rear view of a light device having an open accessory compartment structured in accordance with one embodiment of the invention.
Figure 9:
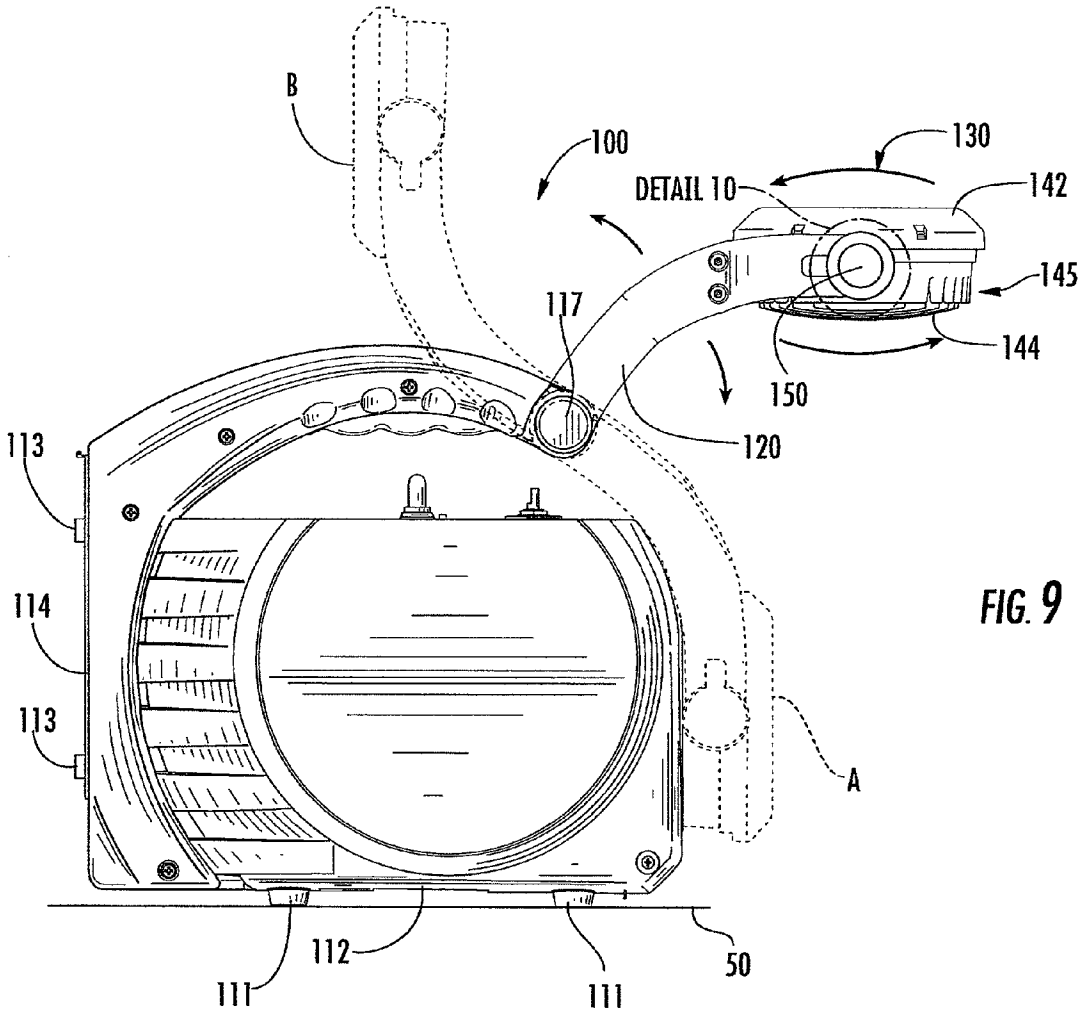
FIG. 9 illustrates a side view of a light device having an extended positionable arm in accordance with one embodiment of the invention.

FIG. 8 depicts a light device 100 having power cords of the type described above. In the depicted embodiment, the power cords are conveniently stored within an aperture 182 defined in the body 110 of the light device 100. The depicted aperture 182 is adapted to receive an AC adapter power cord for electrically coupling the light device 100 to a wall outlet (not shown). The aperture 182 is also adapted to receive a mobile power cord 186 for electrically coupling the light device to a mobile power source such as the cigarette lighter of an automobile (not shown).

Referring again to FIG. 6, various embodiments of the present invention require that electrical power supplied by the electrical power system disposed in the body 110 be routed to the lighting element assembly 130 or other systems (e.g., circuit boards, cooling fans, temperature sensors, and other devices) supported on the pivot member 140. In one embodiment, electrical power is routed through the positionable arm 120 and into the pivot member 140 via first and second electro-mechanical hinge assemblies 150, 151 that are disposed on opposite sides of the pivot member 140 as shown. In other embodiments, a single electro-mechanical hinge assembly may be used with the second hinge being a mechanical hinge that simply accommodates rotation of the pivot member without further electrical coupling. In still other embodiments of the present invention, the electro-mechanical hinges may be used to transmit data and/control signals from process control elements located in the body to various systems located in the pivot member as will be apparent to one of ordinary skill in the art in view of the following disclosure.

Figure 10:
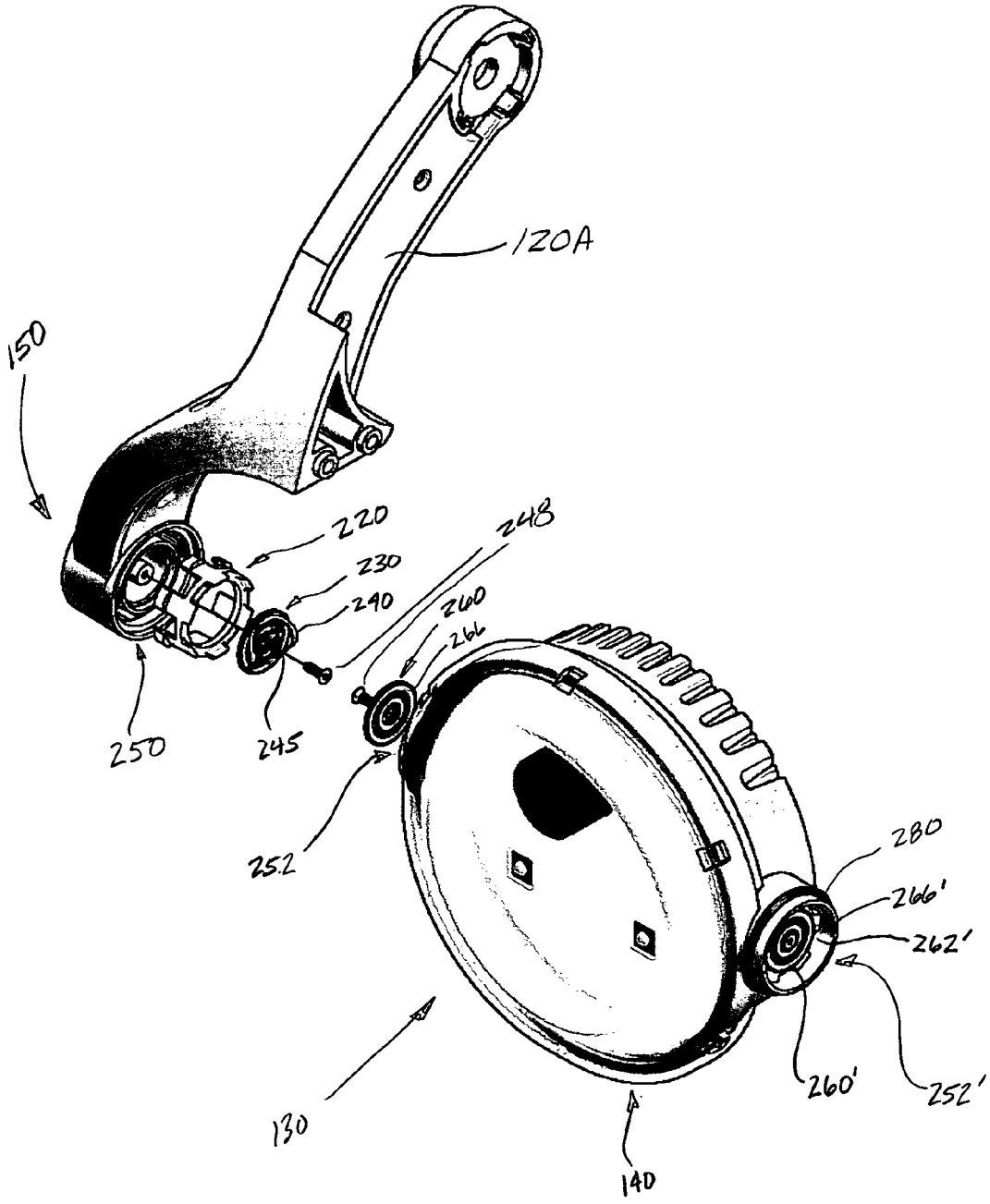
FIG. 10 illustrates an exploded view of an electro-mechanical hinge assembly of a light device structured in accordance with one embodiment of the invention.

FIG. 10 illustrates an electro-mechanical hinge assembly 150 for a light device structured in accordance with one embodiment of the present invention. The depicted electro-mechanical hinge assembly 150 includes a first hinge housing portion 250 defined within the positionable arm 120, a locating member 220, a first electrical circuit member 230, first and second conductive spring members 240, 245, a second electrical circuit member 260, and a second hinge housing portion defined within the pivotal member 140 as shown. Notably, in the depicted embodiment, an additional second hinge housing portion 260' is defined on an opposite of the pivot member 140 for use in a second electro-mechanical hinge assembly 150' as will be apparent to one of ordinary skill in the art.

Figure 10A:
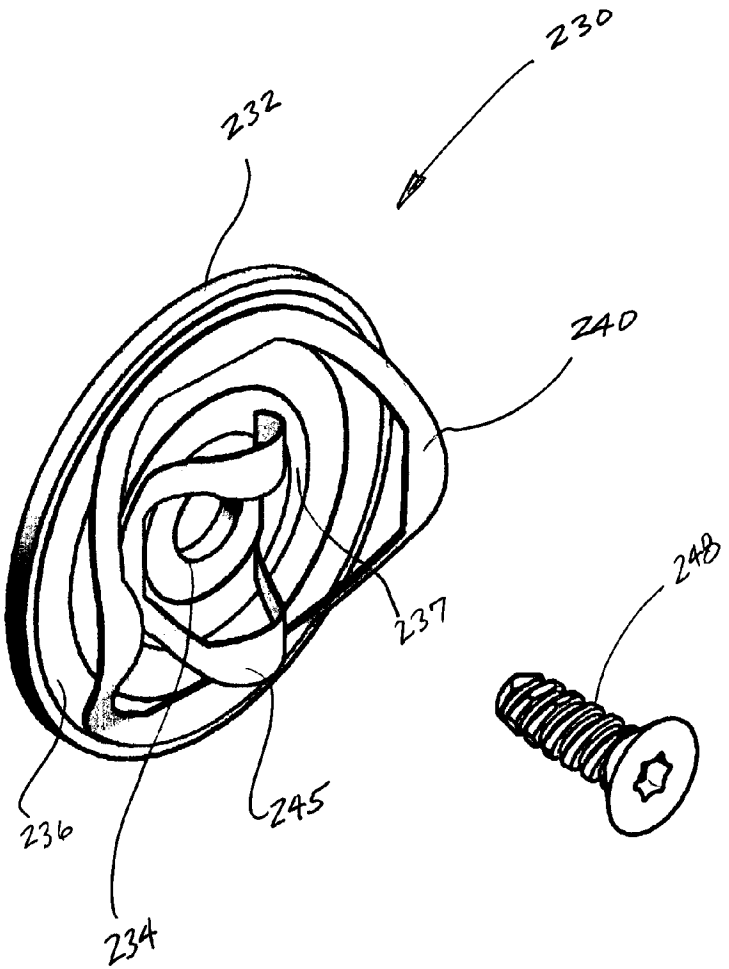
FIG. 10A is a detail view of a first electrical circuit member and first and second electrically conductive springs structured in accordance with one embodiment of the present invention.

FIG. 10A is a detail illustration of a first electrical circuit member 230 and first and second electrically conductive contact springs structured in accordance with one embodiment of the present invention. The depicted first electrical circuit member 230 comprises a printed circuit board 232 defining an aperture 234 for receiving a fastener 248 as shown. In various embodiments, the fastener 248 is adapted to couple the first electrical circuit member 230 to the positionable arm 120 as suggested by FIG. 10. The first electrical circuit member 230 may further comprise one or more electrical contact portions 236, 237 that are disposed in electrical communication with the light device battery and/or electrical power cords (not shown) through wiring and/or corresponding electrical circuitry that is routed through the positionable arm 120. In various embodiments, the one or more electrical contact portions 236, 237 may be comprised of a conductive metal such as copper, silver, gold, and the like. In the depicted embodiment, the one or more electrical contact portions 236, 237 are configured in a generally circular and continuous shape; however, in alternate embodiments the electrical contact portions 236, 237 may be discontinuous discrete contact portions of any shape.

Referring again to FIG. 10, the depicted electro-mechanical hinge assembly 150 also includes a second hinge housing portion 252 that is defined within the pivot member 140 and is structured to support a second electrical circuit member 260. Similar to the structure of the first electrical circuit member 230, the second electrical circuit member 260 comprises a printed circuit board defining an aperture for receiving a fastener 248 as shown. In various embodiments, the fastener 248 is adapted to couple the second electrical circuit member 260 to the pivot member 140 as suggested by FIG. 10. The second electrical circuit member 260 may further comprise one or more electrical contact portions 266 structured similarly to the contact portions referenced above that are disposed in electrical communication with the array of LEDs of the lighting element assembly (item 130 of FIG. 6) through wiring and/or corresponding electrical circuitry routed through the pivot member 140. In other embodiments, the second electrical circuit member 260 may be disposed in electrical communication with other electrical systems provided within the pivot member 140 such as cooling fans, temperature sensors, and the like.

In one embodiment, the positionable arm 120 is comprised of a first portion 120A and a second portion (reference number 120B of FIG. 6). For purposes of simplicity, the foregoing description discusses the structure and operation of a single electro-mechanical hinge 150 as applied to a single portion 120A of the positionable arm 120. As will be apparent to one of ordinary skill in the art, a second electro-mechanical hinge 150' generally identical to the first electro-mechanical hinge 150 is provided on the opposite side of the pivot member in the depicted embodiment. The first and second electro-mechanical hinge portions 150, 150' are structured to rotatably capture the pivot member 140 between the first and second portions 120A, 120B of the positionable arm 120 as will be discussed in greater detail below.

Figure 10B:
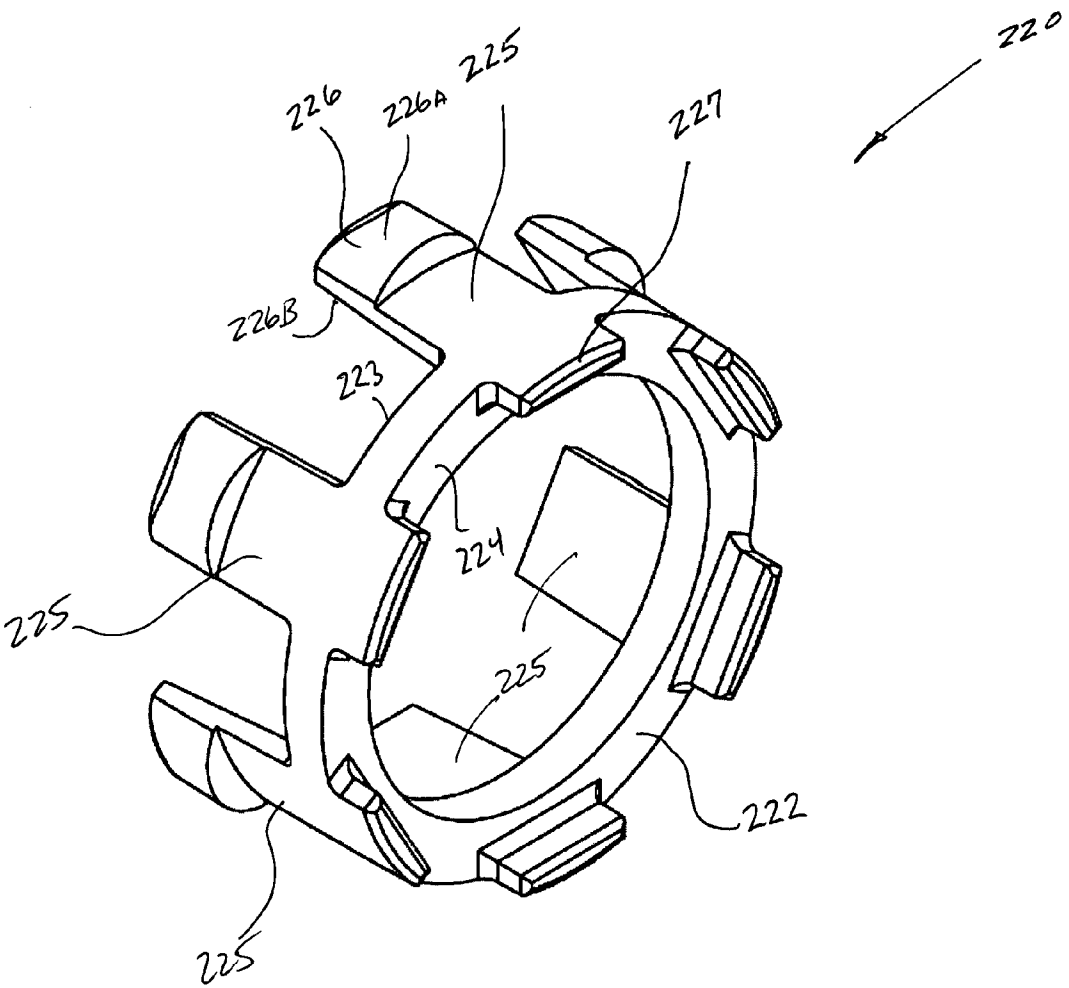
FIG. 10B is a detail view of a locating member used in an electro-mechanical hinge structured in accordance with one embodiment of the present invention.

FIG. 10B is a detail illustration of a locating member 220 used in an electro-mechanical hinge 150 structured in accordance with one embodiment of the invention. The depicted locating member 220 comprises a ring-shaped body 222 defining a plurality of fingers 225 extending therefrom. In one embodiment, the fingers 225 include a barbed portion 226 extending generally from a first side 223 of the ring-shaped body 222 and a locking portion 227 extending generally from a second side 224 of the ring-shaped body 222. The depicted locking portions 227 of the fingers 225 are structured to be received by a corresponding plurality of apertures 262, 262' defined within second hinge housing portions 260, 260' of the pivot member 140 as shown generally in FIG. 10.

Figure 10C:
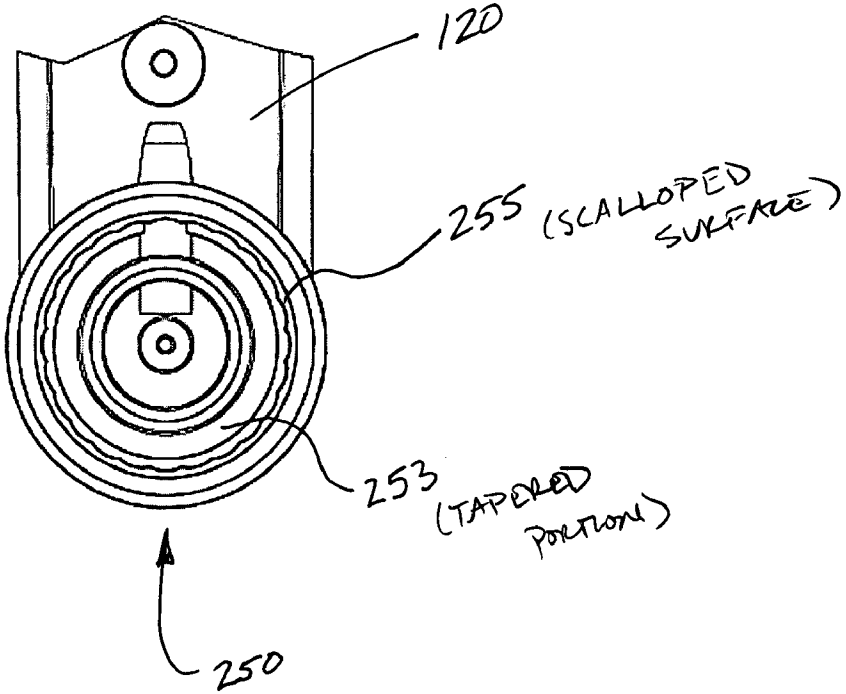
FIG. 10C is a detail view of a first housing portion used in an electro-mechanical hinge structured in accordance with one embodiment of the present invention.

In the depicted embodiment, the barbed portion 226 of the fingers 225 define an arcuate portion 226A and a generally planar portion 226B. FIG. 10C is a detail illustration of a first hinge housing portion 250 structured in accordance with one embodiment of the present invention. The depicted hinge housing portion 250 defines a generally radially extending tapered surface 253 and a generally radially extending scalloped surface 255 disposed radially outwardly from the tapered surface 253.

In one embodiment, the generally planar surfaces 226B of the fingers 225 of the locating member 220 are slidably received by the tapered surface 253 of the first hinge housing 250. The scalloped surface 255 of the first hinge housing 250 is structured at a distance from the tapered surface 253 so as to slideably receive the arcuate portions 226A of the fingers 225 in an indexing fashion. In this regard, once the pivot member 140 is captured between the first and second portions 120A, 120B of the positionable arm 120, the pivot member 140 is structured to rotate at fixed intervals along a 360 degree pivot range. In the depicted embodiment, the fingers 225 of the locating member 220 are spaced such that the pivot member 140 is adapted to rotate at fixed intervals of approximately 15 degrees. In alternate embodiments, a variety of fixed intervals may be selected by varying the spacing of the locating member fingers as will be apparent to one of ordinary skill in the art in view of this disclosure.

Referring generally to FIGS. 10 and 10A, the depicted electro-mechanical hinge assembly 150 also includes first and second electrically conductive contact springs 240, 245 that are adapted for positioning between the first electrical circuit member 230 and the second electrical circuit member 260. In various embodiments, the first and second electrically conductive contact springs 240, 245 are structured for contacting and electrically connecting the contacts 236, 266 of the first and second electrical circuit members 230, 260. In one embodiment, the electrically conductive contact springs 240, 245 may define a wavy or s-shaped longitudinal structure as shown. In alternate embodiments, more or fewer electrically conductive contact springs may be used for electrically connecting one or more contacts provided on the first and second electrical circuit members.

In the depicted embodiment, the locating member 220, the first electrical circuit member 230, the first and second electrically conductive contact springs 240, 245 and the second electrical circuit member 260 are captured between the first hinge housing portion 250 and the second hinge housing portion 252 when the pivot member 140 has been properly installed. O-rings or other sealing members may be provided between the first and second hinge housing portions for sealing the electro-mechanical hinge as shown. In this regard, the first electrical circuit member 230, the first and second electrically conductive contact springs 240, 245 and the second electrical circuit member 260 are captured against one another. Accordingly, electrical communication is maintained between the first electrical circuit member 230 and the second electrical circuit member 260 despite any relative rotation between the pivot member 140 and the positionable arm 120 (i.e., first portion 120A, second portion 120B) as will be apparent to one of ordinary skill in the art in view of this disclosure. Said differently, the depicted electro-mechanical hinge 150 is structured to provide uninterrupted electrical power from the battery to the lighting element assembly while also allowing the pivot member to pivot over a pivot range of 360 degrees or more.

Figure 5:
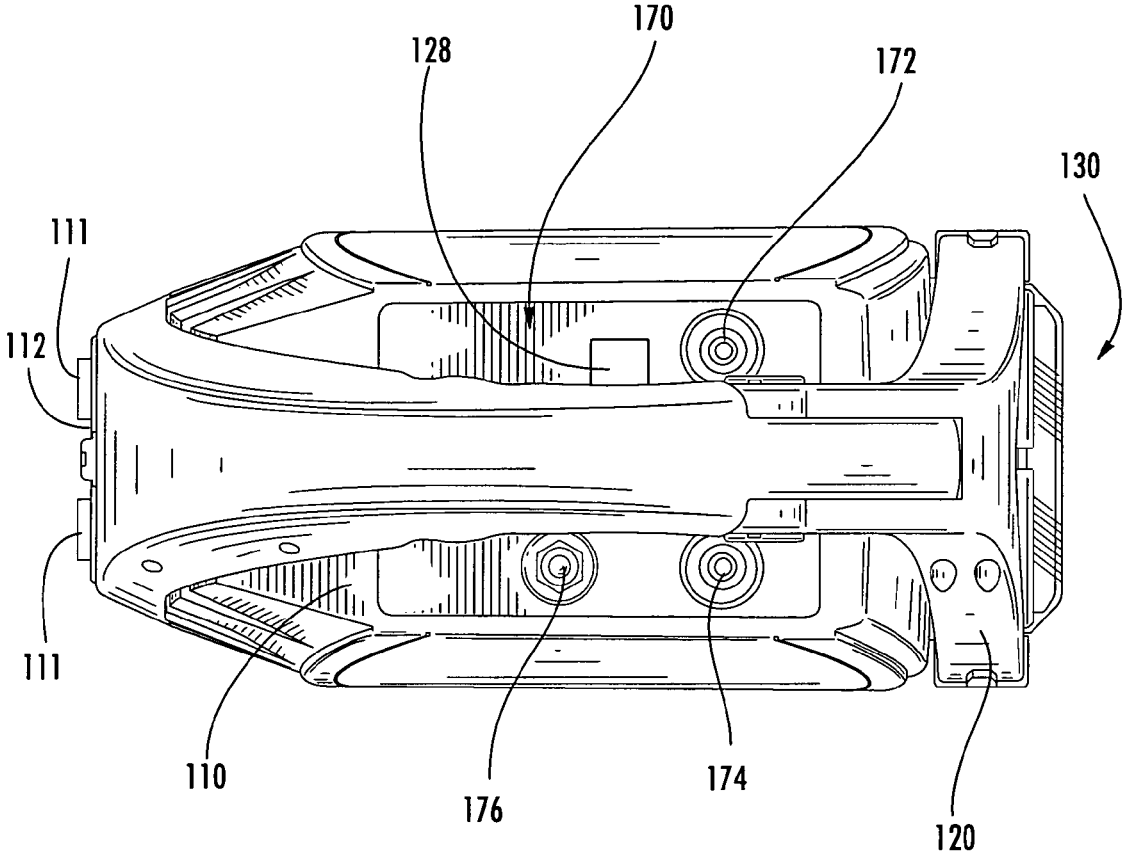
FIG. 5 illustrates a top view of a light device structured in accordance with one embodiment of the invention.

The operation of the depicted light device 100 is controlled by a user interface 170 as shown in greater detail by FIG. 5. In the depicted embodiment, the user interface 170 includes first and second adjustable members 172, 174, a toggle switch 176, and a display 178. In one embodiment, the toggle switch 176 may be adapted to disconnect battery power in order to disconnect erosion of battery capacity during power off conditions. In another embodiment, the toggle switch 176 may be adapted to disconnect battery power and disconnect power from other power sources (e.g., power cords, etc.). In still other embodiments, the toggle switch 176 may be adapted to toggle between various modes of operation including, but not limited to, a brightness control mode, an illumination control mode, and the like. Additional switches, toggles, potentiometers, etc., may be provided as part of the user interface 170 to select the type or capacity of an installed batter, calibration of the light device, a self-calibration or test mode, and other functionalities in addition to those expressly set forth herein.

In one embodiment of the present invention, the light device may be disposed in a brightness control mode wherein the first and second adjustable members 172, 174 are electrically coupled to first and second potentiometers (not shown) that are provided in electrical communication through a process control element with the array of LEDs for controlling the illumination brightness or intensity of the array of LEDs. For example, in one embodiment, the first adjustable member 172 may be adapted to control the brightness of one or more LEDs configured for spot-light illumination and the second adjustable member 174 may be adapted to control the brightness of one or more LEDs configured for flood-light illumination.

In still other embodiments, the light device may be disposed in an illumination control mode whereby the first and second adjustable members 172, 174 incrementally adjust whether the portable light will provide a spot-light mode of illumination, a flood-light mode of illumination, or some combination thereof.

For example, in one embodiment, the first adjustable member 172 may be adapted to designate the percentage of available power that is supplied to one or more LEDs structured for spot-light illumination. Any remaining power may be supplied to one or more LEDs structured for flood-light type illumination. Thus, the first adjustable member 172 may define a spot-light position wherein approximately 100 percent of the available power from the electrical power system is directed to one or more LEDs structured for spot-light illumination, a flood-light position wherein approximately 100 percent of the available power is directed to one or more LEDs structured for flood-light type illumination, and multiple dual mode illumination positions wherein a percentage less than 100 percent of the available power is directed to the spot-light type LEDs and substantially all remaining available power is directed to the flood-light type LEDs.

In illumination control mode embodiments such as the example provided above, the second adjustable member 174 may be adapted to control the brightness or intensity of the illumination provided regardless of whether the first adjustable member 172 is disposed in a spot-light position, a flood-light position, or a dual mode position. In one embodiment, the second adjustable member 174 may be configured to restrict the available power that is distributed to the lighting element assembly 130. For example, the second adjustable member 174 may be set to provide 60 percent of the available power to the lighting element assembly (here the array of LEDs). This 60 percent of available power would then be routed to either the spot or flood light type of LEDs based upon the position of the first adjustable member 172 as described above. In such embodiments, the second adjustable member 174 may be set to provide generally between 0 and 100 percent of the available power to the lighting element assembly as will be apparent to one of ordinary skill in the art.

As noted above, the user interface 170 may include a display 178 such as the depicted liquid crystal display. In the depicted embodiment, the display 178 is disposed in electronic communication with a fuel gauge system and is thereby adapted to display a power supply message including the percentage of battery charge capacity remaining and/or the batter charge capacity remaining in units of time (e.g., months, weeks, days, hours, minutes, seconds, etc.). The display 178 may also indicate which power source is presently activated (e.g., battery, wall outlet power supply, mobile cord power supply, etc.) and whether a power drain device (e.g., cell phone, laptop, radio, PDA, vehicle battery, etc.) is drawing power from the electrical power system. The display may also indicate other system information including, but not limited to, the mode of operation, system configuration data, calibration data, system status information, and other information.

Additionally, the display 178 may provide an indication of the brightness or intensity of the illumination provided by the light device in the brightness control mode or may provide an indication of the relative positions of the first and second adjustable members in the illumination control mode. For example, the display could indicate that 75 percent of light device's available power is directed to its array of LEDs with 20 percent of that power being directed to spot-light type LEDs while 80 percent of that is power is directed to flood-light type LEDs. Finally, the display 178 may provide other information related to the operation of the light device as may be apparent to one of ordinary skill in the art in view of this disclosure.

In another embodiment of the present invention, one or more program modes may be stored in a non-volatile memory (e.g., flip-flop or other two-state device, flash memory, EEPROM, CMOS, etc.) of the light device. Such program modes may define specific illumination control modes (e.g., spot, flood, ultraviolet, infrared, etc.), specific brightness or intensity levels, and programs for varying illumination output based upon electrical power information. For example, in one embodiment, a light device may include a program mode that provides selected brightness or intensity levels based upon selected of electrical power system capacity.

Figure 11:
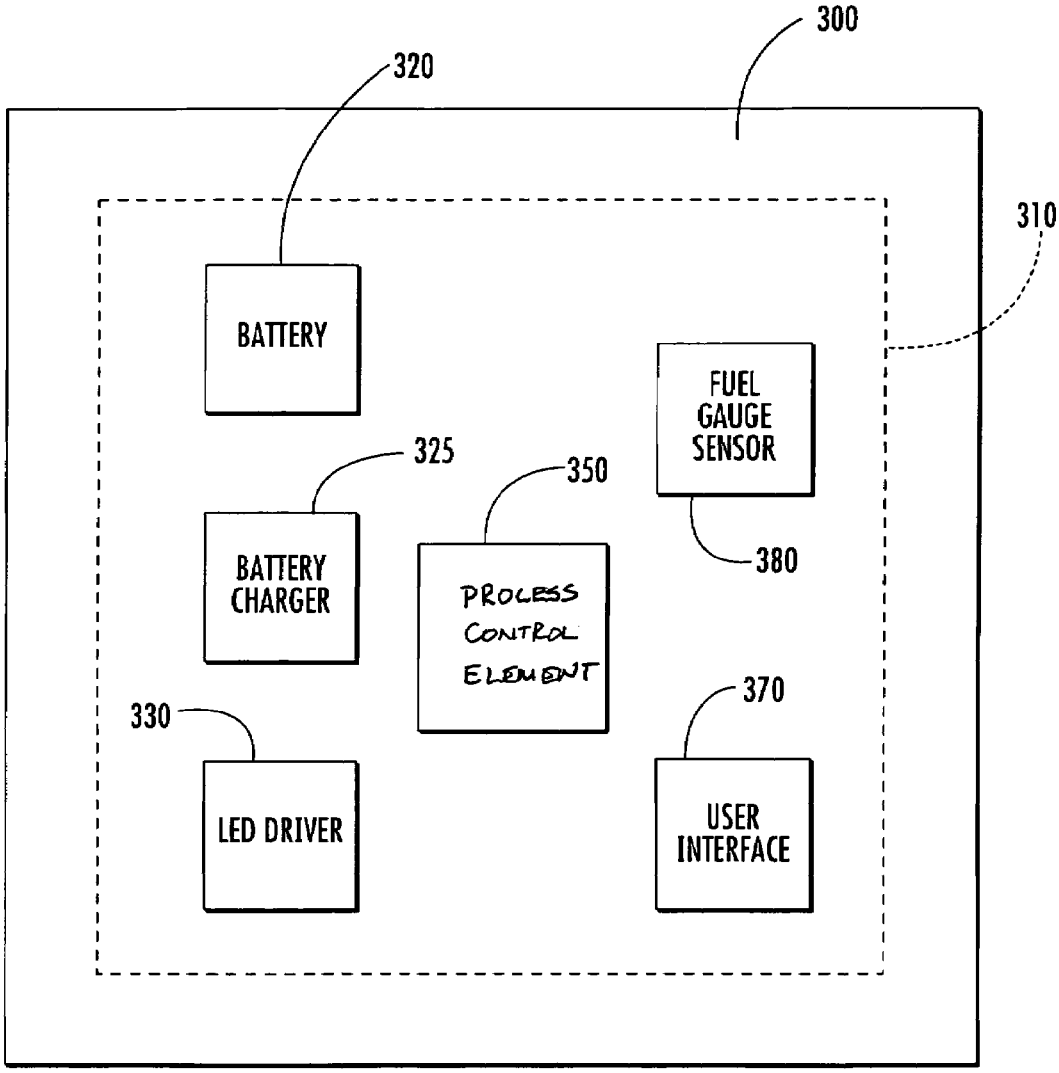
FIG. 11 is a schematic illustration of a control circuit adapted for use in a light device structured in accordance with one embodiment of the invention.

Referring to FIG. 11, a schematic drawing is provided illustrating a lighting device according to one embodiment of the present invention. According to the depicted embodiment, the lighting device includes an electronic circuit board 300 for supporting and electronically connecting an LED driver system 330, a battery charger system 325, a battery 320, a fuel gauge sensor system 380, a process control element 350, and the user interface system 370. In various embodiments, these systems combine to define a control circuit 310 that is the backbone of a light device that is capable of providing effective, user-controlled illumination to a darkened room or area as described in detail below.

In the depicted embodiment, the control circuit 310 is adapted to provide input signals from the user interface system 370 to a process control element 350 such as a CPU, chip, digital signal processor, microcontroller, or other similar device. The process control element 350 processes these inputs and transmits corresponding signals to the LED driver system 330. In this regard, the LEDs of the lighting element assembly may be caused to illuminate in a manner (e.g., spot-light, flood-light, or combination thereof) and intensity that is selected by a user.

In various embodiments, a battery 320 provides power to the process control element 350 and to other systems of the light device. A battery charger system 325 may be provided for replenishing electrical power to the electrical power system. In the depicted embodiment, a fuel gauge sensor system 380 is provided to electrical power information and to provide corresponding electrical signal and/or data inputs to the process control element 350. For purposes of the present invention and appended claims the term "electrical power information" refers to battery current flow during charge or discharge operations, battery voltage, environmental factors such as battery temperature, ambient temperature, ambient humidity, and the like, and non-battery power information such as the presence or absence of external power sources (e.g., wall outlets, vehicle batteries, etc.) and the presence or absence of external power drains (e.g., device drawing power from the light device such as PDAs, laptops, cell phones, vehicle batteries, etc.). The process control element 350 may be adapted to interpret these signals and provide power supply messages to the display. Various process control elements are currently known that possess fuel gauge sensing functionality. For example, in one embodiment, a PS810 fuel gauge microcontroller manufactured by Microchip Technology, Inc., may be used. In another embodiment, a dedicated fuel gauge system may be provided that is part of a battery pack or electrical power system that is adapted to provide input signals and data to a separate process control element that is adapted for driving the light device.

Figure 12:
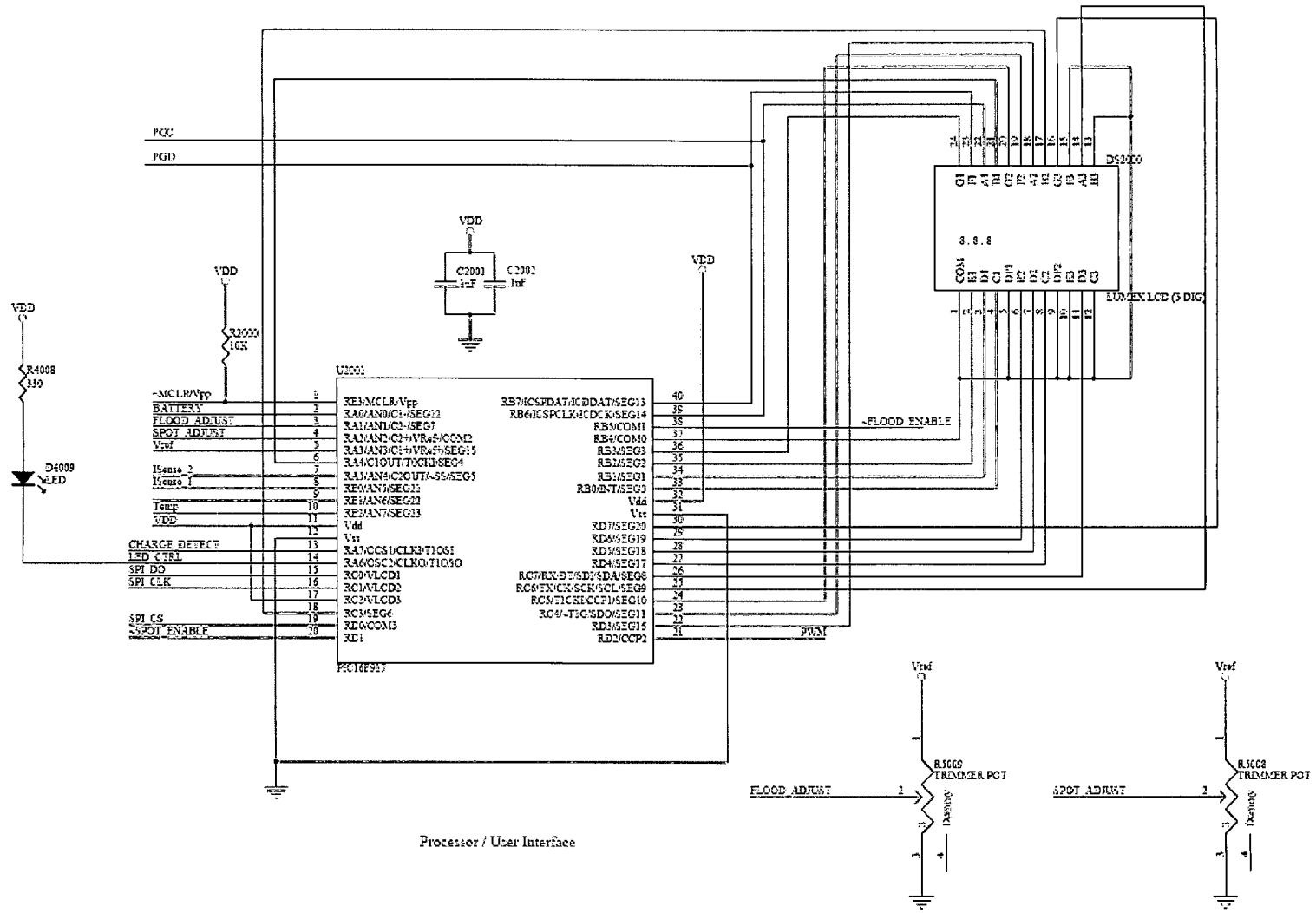
FIG. 12 is an electronic circuit diagram illustrating an exemplary processor/user interface system that may be used in a light device structured in accordance with one embodiment of the invention.
Figure 13:
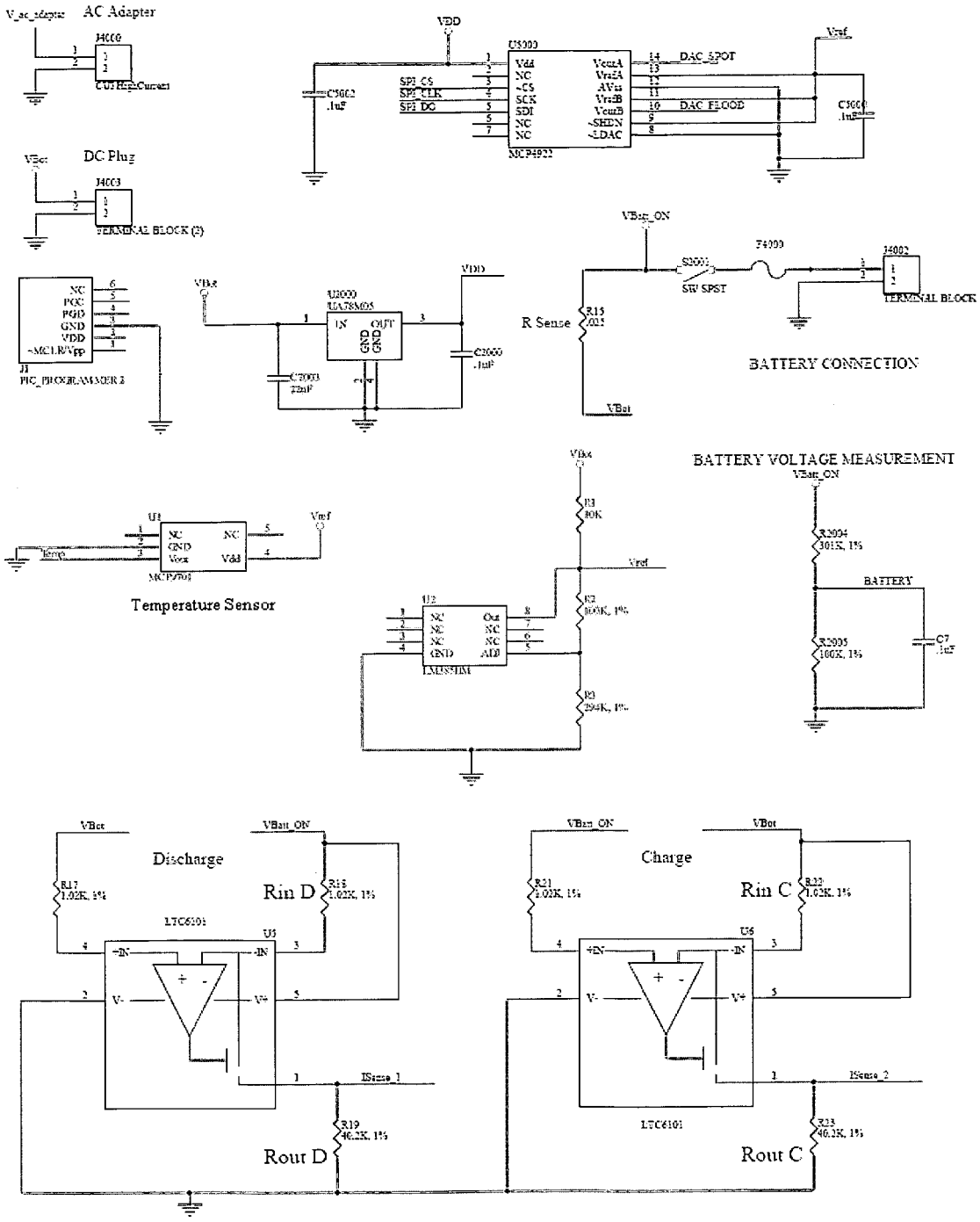
FIG. 13 is an electronic circuit diagram illustrating several exemplary sensor systems that may be used in a light device structured in accordance with one embodiment of the invention.
Figure 14:
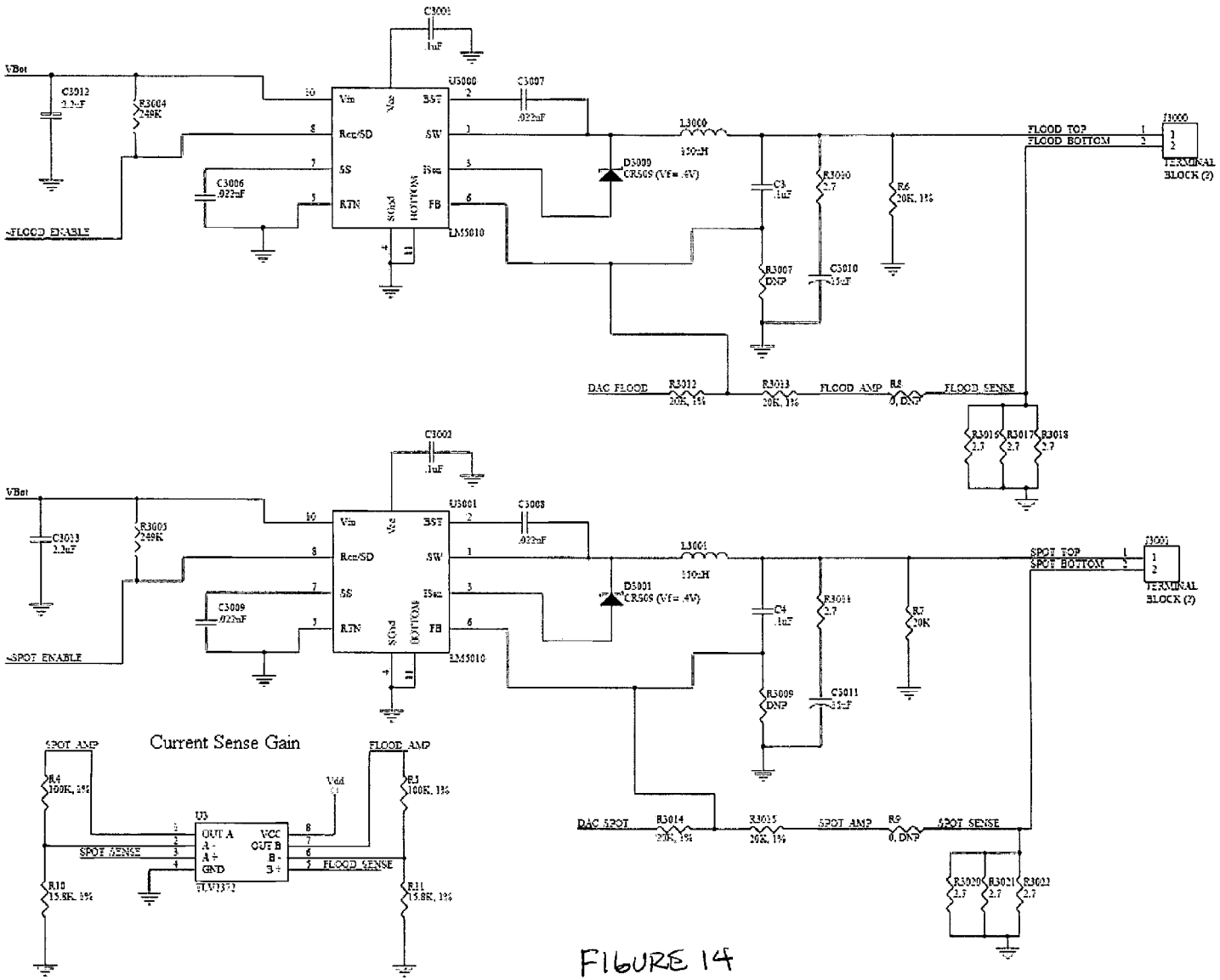
FIG. 14 is an electrical circuit diagram illustrating an exemplary LED driver system that may be used in a light device structured in accordance with one embodiment of the invention.

FIGS. 12-14 provide electrical circuit diagrams illustrating various exemplary circuits that are adapted to perform several of the operations that are noted above. The specific circuit embodiments described in FIGS. 12-14 are provided merely for illustration purposes and should not be construed as limiting.

FIG. 12 depicts an electrical circuit diagram of a processor/user interface system used in a light device structured in accordance with one embodiment of the present invention. FIG. 13 depicts an electrical circuit diagram depicting multiple exemplary sensors that may be used in a light device structured in accordance with one embodiment of the present invention. As will be apparent to one of ordinary skill in the art, FIG. 13 depicts several electrical power system information sensor circuits. FIG. 14 depicts an electrical circuit diagram depicting an LED driver system that may be used in a light device structured in accordance with one embodiment of the present invention.

Figure 15:
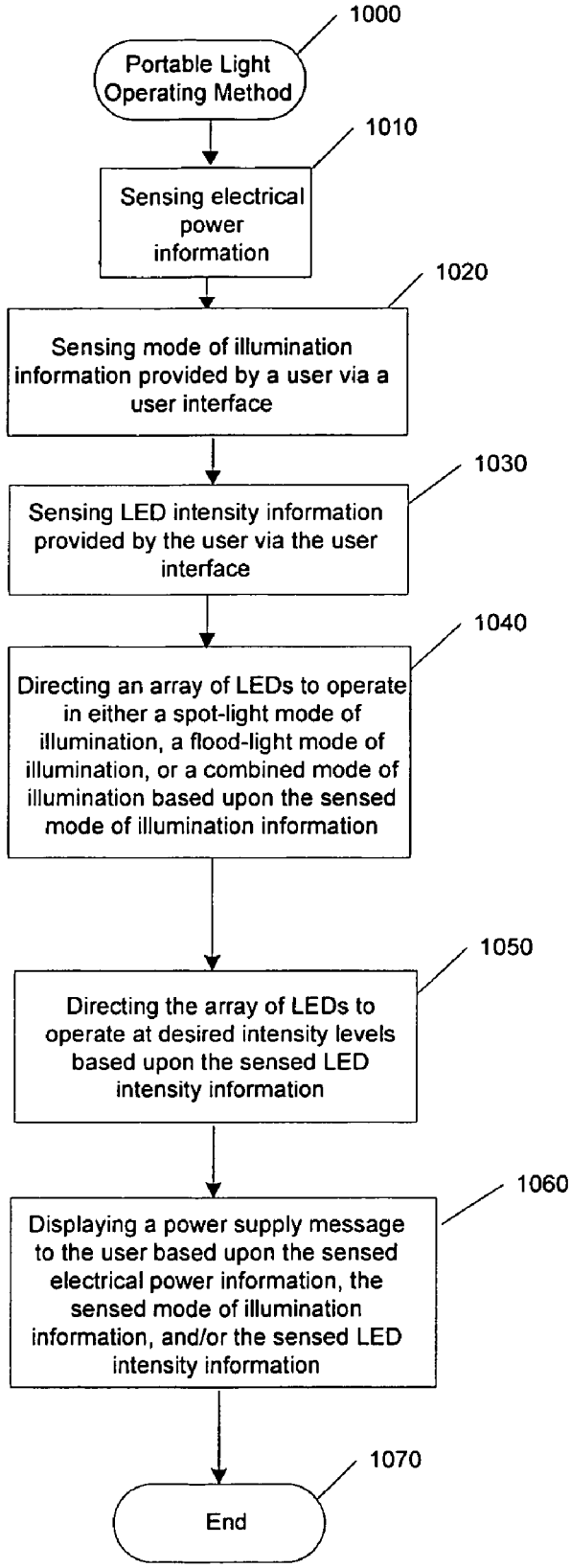
FIG. 15 is flow diagram illustrating a method of operating a light device in accordance with one embodiment of the invention.

FIG. 15 is a flowchart illustrating a portable light operating method in accordance with one embodiment of the present invention. To perform the depicted portable light operating method 1000, the processor, microcontroller, CPU, chip, digital signal processor, firmware, and/or like process control element of the light device senses electrical power information associated with an electrical power system at step 1010. In various embodiments of the present invention, the step of sensing electrical power information may include monitoring current flow during charge or discharge operations, monitoring battery voltage, monitoring environmental factors such as battery temperature, ambient temperature, ambient humidity, and the like, and monitoring non-battery power information such as the presence or absence of external power sources (e.g., wall outlets, vehicle batteries, etc.) and the presence or absence of external power drains (e.g., device drawing power from the light device such as PDAs, laptops, cell phones, vehicle batteries, etc.).

The process control element of the light device also senses mode of illumination information provided by a user via a user interface at step 1020. In various embodiments of the present invention, the step of sensing mode of illumination information may include sensing the position of a switch, button, dial, potentiometer, or other similar device or receiving a command from a touch screen display, wireless remote, or other similar device for indicating whether one or more LEDs of the light device's LED array are to be engaged in a spot-light mode of illumination, a flood-light mode of illumination, or some combination thereof.

The process control element of the light device also senses LED intensity information provided by the user via the user interface at step 1030. In various embodiments of the present invention, the step of sensing LED intensity information may include sensing the position of one or more switches, buttons, dials, potentiometers, or other similar devices. In still other embodiments, such information may be provided by a touch screen display or wireless remote.

Upon sensing the mode of illumination information at step 1020, the process control element directs an array of LEDs via corresponding circuitry to operate at step 1040 in either a spot-light mode of illumination, a flood-light mode of illumination, or a dual illumination mode (e.g., combined spot and flood light illumination) based upon the sensed mode of illumination information. In various embodiments of the invention, one or more of the array of LEDs may be structured to provide the spot-light mode of illumination using a narrowing lens such as an LED optic as discussed above.

Upon sensing LED intensity information at step 1030, the process control element directs the array of LEDs to operate at desired intensity levels at step 1050. Finally, the process control element engages the display to provide a power supply message at step 1060. In various embodiments, the power supply message may be based upon the sensed electrical power information, the sensed mode of illumination information, and the sensed LED intensity information. In one embodiment, the power supply message may include a remaining battery capacity on a percentage basis. In another embodiment, the power supply message may include a remaining battery capacity on a time interval basis (e.g., months, weeks, days, hours, minutes, seconds, etc.). In still other embodiments, the process control element may provide other light device system information to the display including, but not limited to, the mode of operation, system configuration data, calibration data, system status information, and other information.

As will be appreciated by one skilled in the art, the present invention may be embodied as a method of operating a light device or a computer (e.g., logic employing chip, processor, and the like) program product. Accordingly, the present invention may take the form of an entirely hardware embodiment, an entirely software embodiment or an embodiment combining software and hardware aspects. Furthermore, the present invention may take the form of a computer program product on a computer-readable storage medium having computer-readable program code means embodied in the storage medium. More particularly, the present invention may take the form of web-implanted computer software. Any suitable computer-readable storage medium may be utilized including hard disks, CD-ROMs, optical storage devices, or magnetic storage devices.

The present invention is described above with reference to flowchart illustrations of methods and various illustrations of light apparatuses according to several embodiments of the invention. It will be understood that each block and combination of blocks in the flowchart illustrations, can be implemented by computer program instructions. These computer program instructions may be loaded onto a general purpose computer, special purpose computer, or other programmable data processing apparatus to produce a machine, such that instructions which are executed on the computer or other programmable signal/data processing apparatus create means for implementing the function specified in the flowchart block or blocks.

These computer program instructions and/or other programming data may also be stored in a computer-readable memory that can direct a computer or other programmable data processing apparatus to function in a particular manner, such that the instructions and/or data stored in the computer-readable memory produce a light operation method including instruction means that implement the function specified in the flowchart block or blocks. The computer program instructions and/or other programming data may also be loaded onto a computer or other programmable data processing apparatus to cause a series of operational steps to be performed on the computer or other programmable apparatus to produce a computer implemented process such that the instructions that execute on the computer or programmable apparatus provide steps for implementing the function specified in the flowchart block or blocks.

Accordingly, the flowchart illustrations support combinations of means for performing the specified functions, combinations of steps for performing the specified functions and program instruction means for performing the specified functions. It will also be understood that each block of the flowchart instructions, and combinations of blocks in the block diagrams and flowchart instructions, can be implemented by special purpose hardware-based computer systems that perform the specified function or steps, or combinations of special purpose hardware and computer instructions.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A light device, comprising:

a first array of LEDs structured to provide a spot-light mode of illumination at an alterable first intensity level;

a second array of LEDs structured to provide a flood-light mode of illumination at an alterable second intensity level;

an electrical power system structured to provide electrical power to the first array of LEDs and the second array of LEDs;

a user interface structured to allow a user to change an operating mode between the spot-light mode of illumination, the flood-light mode of illumination, and a combination thereof, and further structured to allow the user to change the first intensity level and the second intensity level;

one or more sensors disposed in electrical communication with the electrical power system for sensing electrical power information;

a display; and control circuitry disposed in electrical communication with the first array of LEDs, the second array of LEDs, the electrical power system, the user interface, the one or more sensors, and the display, wherein the control circuitry is adapted to present and update a power supply message to the display based upon the sensed electrical power information, the operating mode, the first intensity level, and the second intensity level.

2. The light device of claim 1, wherein the power supply message presented and updated to the display includes a remaining battery capacity percentage.

3. The light device of claim 1, wherein the power supply message presented and updated to the display includes a remaining battery life on a time interval basis.

4. The light device of claim 1, wherein the first array of LEDs are structured to provide the spot-light mode of illumination by positioning each of the first array of LEDs in reflective proximity to a narrowing lens.

5. The light device of claim 4, wherein the narrowing lens is an LED optic adapted to focus the illumination provided by the first LED to an illumination cone angle approximately between 4 and 50 degrees.

6. The light device of claim 4, wherein the narrowing lens is an LED optic adapted to focus the illumination provided by the first LED to an illumination cone angle approximately between 15 and 50 degrees.

7. The light device of claim 4, wherein the narrowing lens is an LED optic adapted to focus the illumination provided by the first LED to an illumination cone angle approximately between 4 and 30 degrees.

8. The light device of claim 4, wherein the narrowing lens is an LED optic adapted to focus the illumination provided by the first LED to an illumination cone angle approximately between 4 and 15 degrees.

9. The light device of claim 1, wherein the second array of LEDs are structured to provide the flood-light mode of illumination by not being disposed in reflective proximity to an LED optic.

10. The light device of claim 1, further comprising a rechargeable battery for driving illumination of the light device.

11. The light device of claim 1, wherein the user interface includes first and second adjustable members coupled to first and second potentiometers, the first and second potentiometers for controlling the illumination brightness or intensity of the first and second arrays of LEDs.

12. The light device of claim 1, wherein the user interface includes first and second adjustable members coupled to first and second potentiometers, the first and second potentiometers for incrementally adjusting the operating mode between the spot-light mode of illumination, the flood-light mode of illumination, and a combination thereof.

13. The light device of claim 1, wherein the user interface includes a first adjustable member for designating a percentage of available power to supply to the first array of LEDs.

14. A method of operating a light device comprising the steps of:

sensing electrical power information;

sensing mode of illumination information provided by a user via a user interface;

sensing LED intensity information provided by the user via the user interface;

directing an array of LEDs to operate in either a spot-light mode of illumination, a flood-light mode of illumination, or a combined mode of illumination based upon the sensed mode of illumination information;

directing the array of LEDs to operate at desired intensity levels based upon the sensed LED intensity information; and displaying a power supply message to the user based upon the sensed battery electrical power information, the sensed mode of illumination information, and the sensed LED intensity information.

15. The method of operating a light device recited in claim 14, further comprising the steps of:

sensing light device system information; and displaying a system information message to the user based upon the sensed light device system information.

16. The method of operating a light device recited in claim 14, wherein sensing electrical power information comprises monitoring the presence or absence of external power drains.

17. The method of operating a light device recited in claim 14, wherein sensing electrical power information comprises monitoring at least one of current flow during charge and discharge operations, battery voltage, battery temperature, ambient temperature, or ambient humidity.

18. The method of operating a light device recited in claim 14, wherein displaying the power supply message comprises displaying the power supply message, the power supply message being an indication of the remaining battery capacity on a percentage basis.

19. The method of operating a light device recited in claim 14, wherein displaying the power supply message comprises displaying the power supply message, the power supply message being an indication of the remaining battery capacity on a time interval basis.

20. A computer-readable medium storing computer-executable instructions for operating a light device comprising the steps of:

sensing electrical power information;

sensing mode of illumination information provided by a user via a user interface;

sensing LED intensity information provided by the user via the user interface;

directing an array of LEDs to operate in either a spot-light mode of illumination, a flood-light mode of illumination, or a combined mode of illumination based upon the sensed mode of illumination information;

directing the array of LEDs to operate at desired intensity levels based upon the sensed LED intensity information; and displaying a power supply message to the user based upon the sensed electrical power information, the sensed mode of illumination information, and the sensed LED intensity information.

21. The computer-readable medium storing computer-executable instructions for operating a light device recited in claim 20, further comprising the steps of:

sensing light device system information; and displaying a system information message to the user based upon the sensed light device system information.

* * * * *